United States Patent [19]

Blizzard

[11] Patent Number: 4,588,029

[45] Date of Patent: May 13, 1986

[54] EXPANDABLE METAL SEAL FOR A WELL TOOL

[75] Inventor: William A. Blizzard, Houston, Tex.

[73] Assignee: Camco, Incorporated, Houston, Tex.

[21] Appl. No.: 655,388

[22] Filed: Sep. 27, 1984

[51] Int. Cl.[4] ..... E21B 33/12

[52] U.S. Cl. ..... 166/120; 277/236

[58] Field of Search ..... 166/120, 121, 134; 277/116.4, 116.6, 116.8, 228, 117–120, 190, 191, 236

[56] References Cited

U.S. PATENT DOCUMENTS

| | | | |
|---|---|---|---|
| 471,577 | 3/1892 | Stone | 277/120 |
| 843,630 | 2/1907 | Restein | 277/191 |
| 2,075,947 | 4/1937 | Kennedy | 277/117 |
| 3,207,524 | 9/1965 | Trbovich | 277/236 |
| 4,296,806 | 10/1981 | Taylor et al. | 166/120 |
| 4,407,516 | 10/1983 | Le et al. | 277/236 X |
| 4,444,403 | 4/1984 | Morris | 277/228 |

*Primary Examiner*—Stephen J. Novosad
*Assistant Examiner*—Thuy M. Bui
*Attorney, Agent, or Firm*—Fulbright & Jaworski

[57] ABSTRACT

A metal seal on a well tool for sealing between an inner tubular member and an outer tubular member including an annular metal ring positioned about the inner member having a pair of spaced lips on the outer periphery with a flowable metal insert positioned between the lips. Metal seals are provided on each side of the metal ring sealing between each side of the ring and the inner member. Fingers between the setting mechanism and the metal ring expand the metal ring outwardly upon movement of the setting mechanism. An expandable metal support is positioned on the outside of the setting mechanism adjacent the outer edge of the metal ring for supporting the ring as the ring is set. The setting mechanism includes a pair of expansion rings having coacting tapered faces for increasing the setting force as the temperature increases.

16 Claims, 3 Drawing Figures

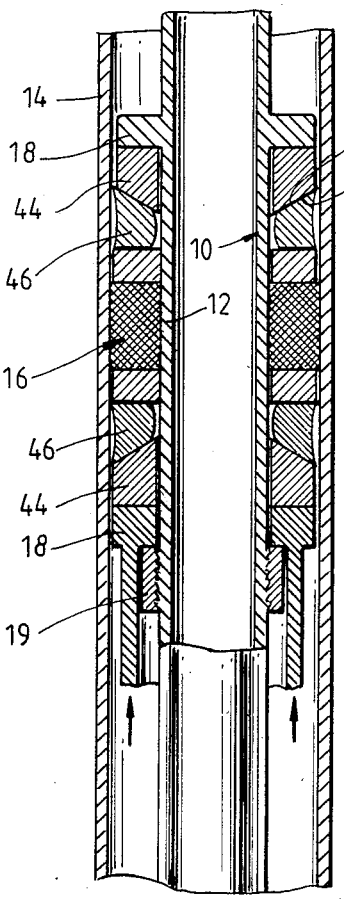
Fig. 1
Fig. 2 A
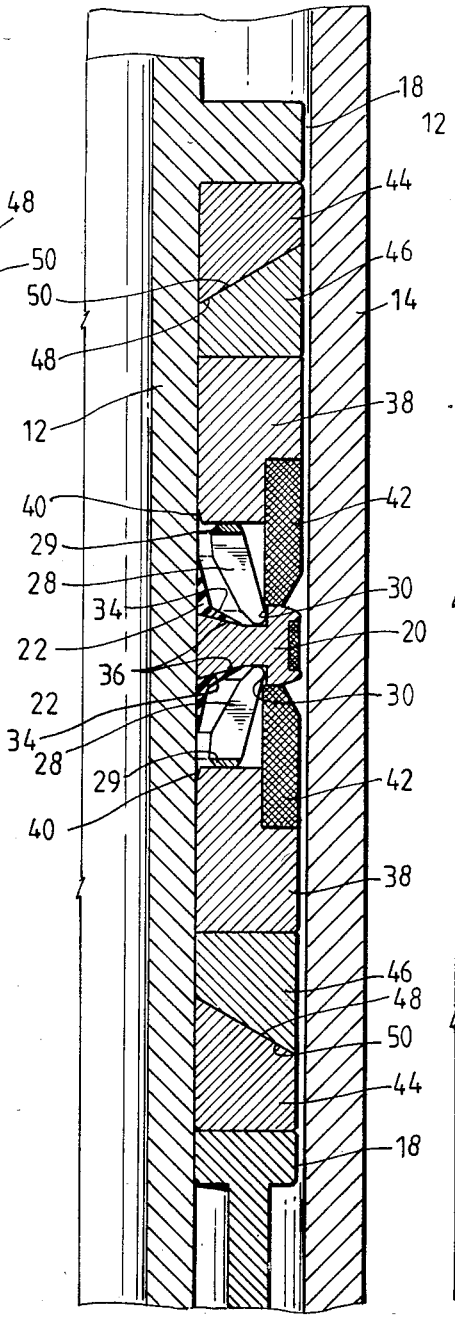
Fig. 2 B
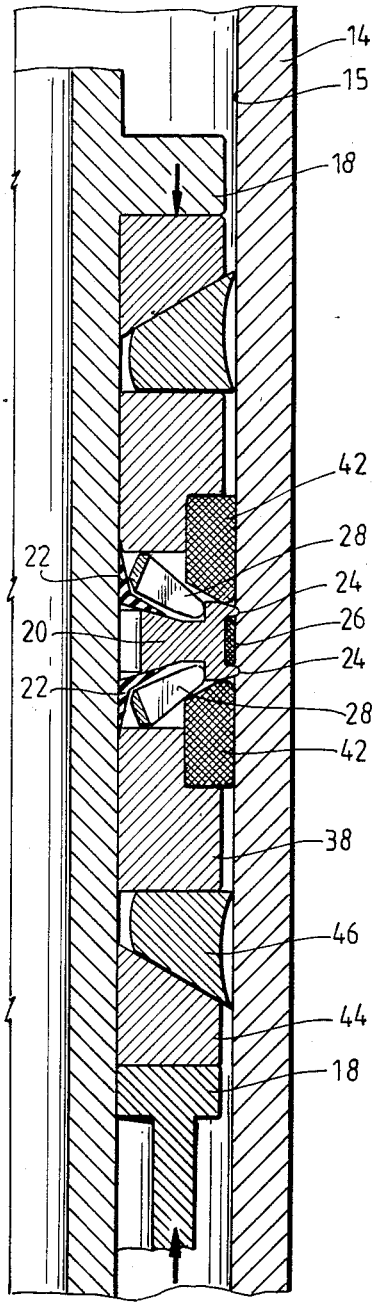

EXPANDABLE METAL SEAL FOR A WELL TOOL

BACKGROUND OF THE INVENTION

Due to the inability of conventional elastomeric components to function well in high temperature or corrosive environments encountered in oil and gas wells, there exists a need for a seal for use in downhole well equipment that will withstand harsh environmental conditions. Such a seal is needed on various well tools such as packers, expansion joints and subs. For example, packers are used in steam injection wells to provide a zone isolating pressure sealing tool that establishes an annular seal between the well casing and the well tubing. In this particular type of application, the steam injection well's operating characteristics create a severe test which conventional sealing materials are unable to meet. In the steam injection process, the injection phase of the operation causes the well equipment to approach temperatures of 650° F., but during the producing phase, the temperatures drop to as low as 80° F. This substantial temperature range, when coupled with pressure differential reversals that commonly occur in downhole environments, subject the well tool seals to conditions which they are unable to overcome. Although semi-elastomers and fiber-type materials such as asbestos and other types of materials such as disclosed in U.S. Pat. No. 4,444,403 have been suggested to combat this problem, their success has been limited.

One feature of the present invention is to provide an expandable metal seal for a well tool and one that will seal in spite of rough surface conditions on the well casing.

Another feature of the present invention is the provision of a series of expansion rings positioned in the seal-setting mechanism for increasing the setting force applied to the seal when the temperature increases. The expansion rings may be a pair of bimetallic expansion rings in which the coefficient of thermal expansion of one of the pair is much greater than the other or the pair of rings may be shape memory effect springs.

SUMMARY

The present invention is directed to a well tool having an expandable seal for sealing off the space between an inner tubular member and an outer tubular member. The seal includes an annular metal ring positioned about the inner tubular member and adapted to expand outwardly for engagement with an outer tubular member and the ring includes a pair of annular spaced lips on the outer periphery of the ring. A flowable metal insert is positioned between the lips for sealing against the outer member. Preferably the insert includes a soft metal filler in a wire mesh substrate which can penetrate the asperities within the surface of the outer tubular member or well casing. Preferably, the lips can protrude into the surface of the well casing and act as a zero clearance backup for preventing extrusion of the insert. Also, because the lips penetrate the rough, typically heavy scaled, surface of the outer member they eliminate any deterimental affect that a rough surface has. Metal seal means are provided on each side of the metal ring sealing between each side of the ring and the inner member. Setting means are provided on each side of the ring for longitudinally moving relative to each other for expanding and moving the metal ring to a set position in engagement with the outer member. Means are provided between each of the setting means and the metal ring for expanding the metal ring radially outward upon movement of the setting means toward each other.

Still a further object of the present invention is wherein expandable metal support means are provided between each of the setting means and the metal ring adjacent to the outer edge of the metal ring for expanding outwardly as the ring is set and engaging and laterally supporting the ring as the ring is set. Preferably the expandable metal support means includes a metal mesh.

Still a further object of the present invention is the provision of a pair of expansion rings between each of the setting means and the annular metal seal. In one form, the rings are bimetallic rings having different coefficients of thermal expansion and each of the expansion rings has a tapered face engaging the tapered face of the other expansion ring. Therefore, an increase in temperature will cause the ring having the higher coefficient to expand more than the other ring thereby increasing the setting force on the seal as the temperature increases. In another form, the rings are shape memory effect ring springs which have tapered engaging faces. After the ring springs are deformed by an axial load they attempt to return to their shape upon an increase in temperature thereby increasing the axial setting force on the seal.

Yet a still further object of the present invention is wherein the annular metal ring includes a head with an inwardly directed shoulder on each side and wherein the means expanding the metal ring outwardly includes a plurality of annularly positioned fingers directed outwardly toward the inwardly directed shoulders on the metal ring. Preferably the fingers on each side of the ring are connected to each other.

Yet a still further object of the present invention is wherein the metal ring includes a tapered surface on each side directed radially outwardly and inwardly for coacting with the metal seal means on each side of the ring for increasing the sealing relationship between the metal ring and the metal seal means as the metal ring is expanded outwardly.

Still a further object of the present invention is wherein each of the setting means includes a tapered surface adjacent the inner tubular member for engaging one of the metal seal means for sealing the one metal seal means against the inner tubular member.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 1 is a schematical elevational view showing a seal and setting mechanism of the present invention in the set position, FIG. 2A is an enlarged elevational view, in cross section, illustrating the seal and setting mechanism of the present invention in the running position, and FIG. 2B is a view similar to FIG. 2A showing the seal in the set position.

DESCRIPTION OF THE PREFERRED EMBODIMENT

While the seal and setting mechanism of the present invention may be utilized in various types of well tools for use in sealing off the space between an inner and outer tubular member, the present invention, for purposes of illustration only, will be described in connection with use on a well packer for sealing off the annulus between the well casing and the well tubing.

Referring to the drawings, and particularly to FIG. 1, the reference numeral 10 generally indicates a portion of a well packer or other well tool having an inner tubular member 12 which is generally connected to the well tubing in an oil and/or gas well inside of an outer tubular member such as a well casing 14. The packer 10 generally includes seal means generally indicated by the reference numeral 16 for sealing between the inner tubular member 12 and the outer tubular member 14. Initially, the seal means 16 is retracted away from the member 14 when the packer is being moved downhole into the member or casing 14 and thereafter setting means 18 on each side of the packer 16 is provided for moving longitudinally toward each other for compressing and setting the seal means 16 and thereafter holding the seal 16 in the set position by locking means 19 such as ratchets. Generally, the above described well packer is conventional.

One feature of the present invention is directed to an improved seal means 16. As previously indicated, conventional sealing materials are unable to cope with temperature and pressure cycling that commonly occur in downhole well environments, particularly in steam injection wells. The present packer 16, referring now to FIG. 2A, is a packer which relies on metal sealing elements and does not require any plastic, elastomer or asbestos types of materials. The seal 16 includes an annular metal ring generally indicated by the reference numeral 20 positioned about the inner tubular member 12 and adapted to expand outwardly for engagement with the outer tubular member 14. The ring 20 may be any suitable metal ring having good tensile, elongation, and hardness properties such as K500 monel. When the ring 20 is in the expanded position, as best seen in FIG. 2B, the ring 20 will seal and prevent fluid bypass along the interior surface wall 15 of the outer member 14. Seal means 22 are provided on each side of the ring 20 for sealing between each side of the ring 20 and against the exterior surface of the inner tubular member 12 to prevent fluid bypass along the outer surface of member 12. Seal means 22 are metal and may be inconel 718.

It is important that the annular metal ring 20 provides a good seal against the interior surface of the outer member 14 since the inner surface 15 of the member 14 may be rough, and in the event that the casing 14 has been in use for a considerable period of time, the condition of the inner surface of the member 14 may have deteriorated. Therefore, the ring 20 is provided with a pair of annularly spaced lips 24 on the outer periphery of the ring 20. Preferably, the lips 24 are rounded, but sharp enough to protrude into and deform a very small portion of the interior surface 15 of the outer tubular member 14, as best seen in FIG. 2B, to enclose a flowable metal insert 26 which is positioned between the lips 24 for sealing against the interior surface of the member 14. While the insert 26 may be of any flowable metal material and may be solid, it is preferable that the insert 26 have a wire mesh substrate having a soft metal filler. For example, a copper mesh having a lead filler provides a satisfactory seal having the desirable properties of qood elonqation, thermal, and expansion properties. The lips 24 which protrude into the surface 15 of the well casing 14 act as a substantially zero clearance backup for the metal insert 26 for reducing the possibility of extrusion of the insert 26 around the lips 24. The insert 26 consisting of wire mesh substrate with a soft metal filler penetrates the asperities within the surface 15 to insure sealing against the surface 15 even though the metal surface 15 may be in a rough condition. Preferably, the soft metal filler 26 extends to the outer edge of the lip 24 so that as the lips 24 protrude into the casing surface, the filler material 26 is further highly compressed into the asperities of the casing surface 15. This effect substantially aids in preventing well bore fluids from passing through the soft metal filler 26 seal surface.

Setting means 18 on each side of the seal means 16 move longitudinally relative to each other for expanding the metal ring 20 outwardly. Suitable means are provided between each of the setting means 18 and the metal ring 20 for expanding the metal ring 20 outwardly into engagement with the tubular member 14. Such means may include a plurality of annularly positioned fingers 28 directed outwardly toward the metal ring 20. The metal ring 20 preferably includes a head having a downwardy directed shoulder 30 on each side for engagement with the outer ends of the fingers 28. Preferably, the plurality of fingers 28 on each side are connected together by a web 29 for ease of positioning. The fingers 28 are made with any suitable metal material such as 410 stainless steel. Thus, as the setting means 18 creates a longitudinal force acting on the web ends 29 of the fingers 28, the outer ends of the fingers 28 which engage the shoulders 30 transform the setting force into an outward radial force to expand the ring 20 outwardly.

Preferably, the metal ring 20 includes a tapered surface 34 on each side which coacts with each of similar tapered surfaces 36 on the metal seal 22 for increasing the seal between the metal ring 20 and the metal seal means 22 as the ring 20 is moved outwardly.

The setting means 18 may include setting blocks 38 which are preferably provided with a tapered surface 40 adjacent the inner tubular member 12 for engaging one of the metal seals 22 for sealing the metal seals 22 more firmly against the inner member 12.

Expandable metal support means 42 may be provided between each of the setting means 18 and the metal ring 20 adjacent to the outer edge of the metal ring 20 for supporting the ring 20 as the ring is set. Thus, support means 42 which may be of any flowable solid suitable metal, but are preferably a wire mesh such as inconel and are connected to and supported from the outer surface of the setting blocks 38. The support members 42 are not required to provide any sealing function, but physically provide a structural support to the outer end of the ring 20 as it is extruded outwardly to insure that it moves radially outwardly and prevent it from tilting.

The metal seal means 16 of the present invention eliminates extrusion of the seal, avoids the use of elastomers, is able to provide a tight seal against rough inner surface existing on the casing or outer tubular member 14 and therefore will have a substantially longer life and greater reliability than conventional seals.

Another feature of the present invention is the provision of utilizing a series of expansion rings for creating an additional setting force on the seal means 16 as the temperature in the seal environment increases. Thus, referring to FIG. 1, in one form of the invention, a pair of bi-metallic thermal expansion rings 44 and 46 are provided between the seal means 16 and each of the setting means 18. The expansion rings 44 and 46 differ from one another in that they are made from two different materials which vary greatly in their coefficients of thermal expansion. For example only, rings 44 may be of stainless steel and rings 46 may be of aluminum which has a considerably higher thermal coefficient of expansion. Each of the expansion rings 44 and 46 includes a tapered face such as ring 44 having a tapered face 48 and ring 46 having a tapered face 50 with the faces 48 and 50 coacting. During normal setting of the packing means 16, the axial or longitudinal force transmitted by the setting means 18 is transmitted through the rings 46 and 44 to the seal means 16. However, in high temperature applications such as occurs in steam injection wells, the rings 44 and 46 will heat up during steam injection and the ring with the greater coefficient of thermal expansion, here rings 46, will expand more rapidly to provide an increased axial force which increases the setting force supplied to the seal means 16. This additional force is locked in through the ratchets 19 and results in a greater pressure holding capability of the seal 16. Of course, the bi-metallic expansion rings may be used in other applications to increase the setting force on other types of seal means than the particular seal means 16 shown herein.

In another form the metal expansion rings 44 and 46 may be shape memory effect ring springs such as sold under the trademark "NITINOL". In one form one of the rings may be nickel-titanium and the other any suitable metal such as stainless steel. An axial force is applied to the rings as the setting piston 18 sets the seal 16 and the shape memory effect ring springs are diametrically deformed. Once the piston 18 is locked in position by the ratchets 19 a high bearing stress is created in tapered interfaces 48 and 50. A rise in temperature will cause the shape memory effect rings to utilize their unique property by undergoing a transformation of their overall crystal structure and attempt to return to their original shape before any axial forces were applied by the piston 18. The shape memory effect ring springs, by trying to return to their original shape, exert an amount of additional axial force to the seal means 16 thereby enabling the seal 16 to withstand a greater pressure differential.

The shape memory effect rings are advantageous in that they do not require the relatively large temperature differentials that the different coefficient of thermal expansion rings require for actuation. Of course, either types of the wedge shaped expansion rings may be used to set various types of seals 16 and either type of expansion ring may be used to increase the sealing force in a seal regardless of whether the seal is set by one or two pistons.

The present invention, therefore, in well adapted to carry out the objects and attain the ends and advantages mentioned as well as others inherent therein. While presently preferred embodiments of the invention have been given for the purpose of disclosure, numerous changes and details of construction and arrangement of parts will readily suggest themselves to those skilled in the art and which are encompassed within the spirit of the invention and the scope of the appended claims.

What is claimed is:

1. In a well tool having an expandable seal sealing off the space between an inner tubular member and an outer tubular member, the improvement in said seal comprising, an annular metal ring positioned about the inner tubular member and adapted to expand outwardly for engagement with an outer tubular member, said ring including a pair of annular spaced lips on the outer periphery of the ring, a flowable metal insert positioned between said lips for sealing against the outer member, metal seal means on each side of the metal ring for sealing between each side of the ring and the inner member, setting means on each side of the ring for longitudinally moving toward each other for setting the metal ring, and outwardly movable metal means between each of the setting means and the metal ring for expanding the metal ring radially outward upon movement of the setting means toward each other.

2. The apparatus of claim 1 including, expandable metal support means between each of the setting means and the metal ring adjacent the outer edge of the metal ring for expanding outwardly as the ring is set and engaging and laterally supporting the ring as the ring is set.

3. The apparatus of claim 2 wherein the metal support means includes, a metal mesh.

4. The apparatus of claim 1 wherein the setting means includes, a pair of bi-metallic expansion rings which have different coefficients of thermal expansion, each of said expansion rings having a tapered face engaging the tapered face of the other expansion ring.

5. The apparatus of claim 1 wherein the means expanding the metal ring radially outward includes, a plurality of annularly positioned fingers directed outwardly toward the metal ring.

6. The apparatus of claim 1 wherein the metal insert includes, a metal mesh filled with a flowable metal.

7. The apparatus of claim 1 wherein the lips are sharp enough to penetrate into the surface of the outer member.

8. The apparatus of claim 1 wherein the annular metal ring includes, a head with an inwardly directed shoulder on each side for engaging the means for expanding the metal ring.

9. The apparatus of claim 1 wherein the metal ring includes a tapered surface on each side directed radially outwardly and inwardly for coacting with each of the metal seal means for increasing the sealing relationship between the metal ring and said metal seal means as the metal seal ring is moved outwardly.

10. The apparatus of claim 1 wherein each setting means includes, a tapered surface adjacent the inner tubular member for engaging one of the metal seal means for sealing the one metal seal means against the inner tubular member.

11. In a well tool having an expandable seal for-sealing off the space between an inner tubular member and an outer tubular member, the improvement in said seal comprising, an annular metal ring positioned about the inner tubular member and adapted to expand outwardly for engagement with an outer tubular member, said ring including a pair of annular spaced lips on the outer periphery of the ring, a flowable metal insert positioned between said lips for sealing against the outer member, metal seal means on each side of the metal ring sealing between each side of the ring and the inner member, said ring including an inwardly directed shoulder on each side, setting means on each side of the ring on the side of each of the metal seal means opposite the metal ring for longitudinally moving toward each other for setting the metal ring, outwardly movable metal means between each of the setting means and the metal ring and engagable with the inwardly directed shoulders for expanding the metal ring radially outward upon movement of the setting means toward each other, and expandable metal support means positioned on the outer edge of each of the setting means and adjacent the outer edge of the metal ring for expanding outwardly as the ring is set and engaging and laterally supporting the ring as the ring is set.

12. The apparatus of claim 11 wherein the metal insert includes a metal mesh filled with a flowable metal.

13. The apparatus of claim 11 wherein the expandable metal support includes a metal mesh.

14. The apparatus of claim 11 wherein the means for expanding the metal ring radially outward includes, a plurality of annularly positioned and connected fingers directed outwardly toward the metal ring.

15. The apparatus of claim 11 wherein the metal ring includes a tapered surface on each side directed radially outwardly and inwardly for coacting with each of the metal seal means for increasing the sealing relationship between the metal ring and said metal seal means as the metal seal ring is moved outwardly.

16. The apparatus of claim 11 wherein the setting means includes, a pair of thermal expansion rings, each of said expansion rings having a tapered face engaging the tapered face of the other expansion ring.

* * * * *